US008011420B2

(12) United States Patent
Mazzocco et al.

(10) Patent No.: US 8,011,420 B2
(45) Date of Patent: Sep. 6, 2011

(54) CONDENSER ATTACHMENT BRACKET

(75) Inventors: Nicholas Mazzocco, Royal Oak, MI (US); Jason R Hendry, Warren, MI (US); Christopher Wisniewski, Novi, MI (US); Ben C Mullis, Battle Creek, MI (US)

(73) Assignee: DENSO International America, Inc., Southfield, MI (US)

( * ) Notice: Subject to any disclaimer, the term of this patent is extended or adjusted under 35 U.S.C. 154(b) by 1193 days.

(21) Appl. No.: 11/374,640

(22) Filed: Mar. 13, 2006

(65) Prior Publication Data

US 2007/0209372 A1 Sep. 13, 2007

(51) Int. Cl.
*F28F 9/00* (2006.01)

(52) U.S. Cl. ..... 165/67; 165/149; 165/178

(58) Field of Classification Search ..... 165/67, 165/149, 178

See application file for complete search history.

(56) References Cited

U.S. PATENT DOCUMENTS

| | | | | |
|---|---|---|---|---|
| 5,205,349 | A | 4/1993 | Nagao et al. | |
| 5,269,367 | A | 12/1993 | Susa et al. | |
| 5,899,263 | A * | 5/1999 | Tokutake | 165/67 |
| 6,000,460 | A | 12/1999 | Yamanaka et al. | |
| 6,167,946 | B1 | 1/2001 | Uchikawa et al. | |
| 6,237,676 | B1 | 5/2001 | Hasegawa et al. | |
| 6,276,445 | B1 | 8/2001 | Sasano et al. | |
| 6,293,011 | B1 | 9/2001 | Hasegawa et al. | |
| 6,357,519 | B1 | 3/2002 | Ozaki et al. | |
| 6,357,521 | B1 | 3/2002 | Sugimoto et al. | |
| 6,427,768 | B2 | 8/2002 | Komoda et al. | |
| 6,540,015 | B1 | 4/2003 | Kawachi et al. | |
| 6,595,272 | B1 | 7/2003 | Uchikawa et al. | |
| 6,705,387 | B2 | 3/2004 | Kokubunji et al. | |
| 6,708,756 | B2 | 3/2004 | Parola | |
| 6,776,223 | B2 | 8/2004 | Sanada et al. | |
| 6,827,129 | B2 | 12/2004 | Ozawa et al. | |
| 7,036,561 | B2 | 5/2006 | Yagi et al. | |
| 7,044,203 | B2 | 5/2006 | Yagi et al. | |
| 7,131,488 | B2 | 11/2006 | Ozaki | |
| 7,147,046 | B2 | 12/2006 | Sanada et al. | |
| 7,237,605 | B2 | 7/2007 | Ozaki | |
| 7,506,713 | B2 | 3/2009 | Miura et al. | |
| 7,640,966 | B2 | 1/2010 | Maeda et al. | |

FOREIGN PATENT DOCUMENTS

| | | | |
|---|---|---|---|
| JP | 10095227 A | * | 4/1998 |
| JP | 2003106786 A | * | 4/2003 |
| JP | 2004243953 A | * | 9/2004 |

* cited by examiner

*Primary Examiner* — John Ford

(74) *Attorney, Agent, or Firm* — Harness, Dickey & Pierce, PLC

(57) ABSTRACT

A mounting arrangement for a heat exchanger in a vehicle includes a bracket having a main body. A first portion is secured to the heat exchanger and a second portion includes a mounting feature adapted to be secured to another component of the vehicle. A foot is formed on the first portion of the bracket. The foot defines an interface surface brazed to the heat exchanger in an installed position.

15 Claims, 3 Drawing Sheets

CONDENSER ATTACHMENT BRACKET

FIELD OF THE INVENTION

The present invention relates to HVAC systems in vehicles and more particularly to an attachment bracket brazed to a condenser for a vehicle air conditioner.

BACKGROUND OF THE INVENTION

In automotive vehicles, it is common to have a climate control systems to establish and maintain passenger comfort. Typically, climate control systems consist of separate heating and cooling systems. Typically, a heat exchanger called a condenser is included as part of the cooling system for performing heat exchange with the outside air. Heat exchange may be facilitated by a fan to cool and condense refrigerant from a gas into a liquid in the condenser.

Condensers may be provided with jumper tubes for routing fluid from the outlet of the condenser to the connection point of the air conditioning (A/C) plumbing. From the connection point, the fluid may be routed by the A/C plumbing to a desired location such as to a receiver for separating refrigerant into a gas and a liquid. Since heat exchange is desired with the outside air, the engine compartment of the vehicle is generally used to accommodate the condenser. In many instances, packaging the condenser within the engine compartment may bring challenges. Because of these packaging considerations, it is desirable to mount the condenser while occupying a small amount of space and using minimal hardware. What is needed then is a device that facilitates mounting of the condenser in a small space, reduced the number of parts to accomplish such mounting, reduced the number of manufacturing steps involved in the condenser assembly, and provides a more rigid mounting structure.

SUMMARY OF THE INVENTION

A mounting arrangement for a heat exchanger in a vehicle includes a bracket having a main body. A first portion is secured to the heat exchanger and a second portion includes a mounting feature adapted to be secured to another component of the vehicle. A foot is formed on the first portion of the bracket. The foot defines an interface surface brazed to the heat exchanger in an installed position.

According to other features, the heat exchanger defines a pair of offset lateral walls formed thereon. The foot nests between the pair of lateral walls in the installed position. The main body of the bracket generally defines first and second end walls connected by a central wall. The first and second end walls are generally parallel and offset to each other. An inboard face of the central wall may be brazed to an outboard face of the condenser. In one example, the bracket may be formed of extruded aluminum.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
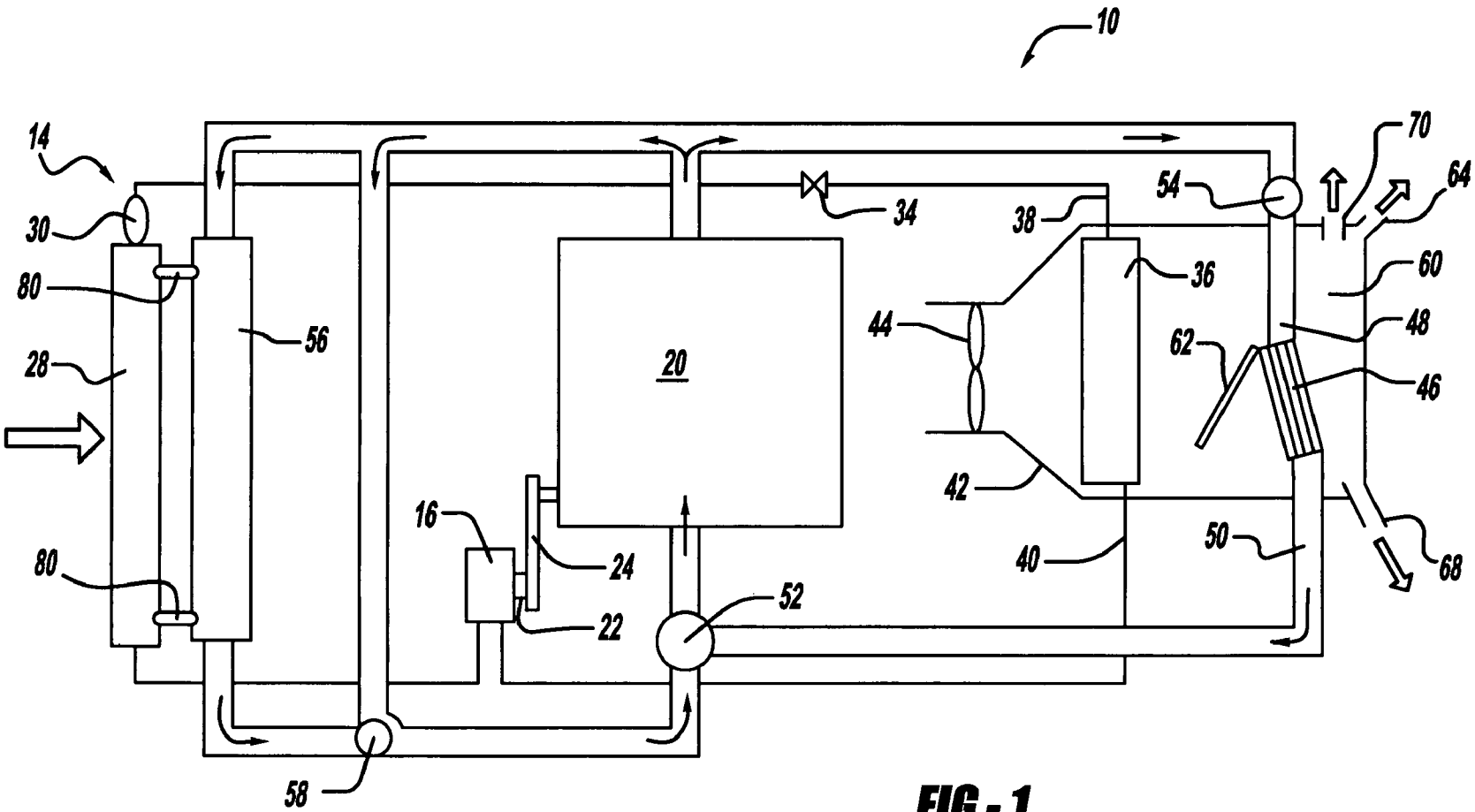
FIG. 1 is a functional diagram depicting various components of an A/C system of a vehicle according to the present teachings.

With initial reference to FIG. 1, a block diagram of a conventional vehicle heating, ventilation and air-conditioning ("HVAC") system is shown and generally identified at reference 10. A refrigeration cycle of the vehicle HVAC system 10 includes an air-cooling system 14. The air-cooling system 14 includes a compressor 16 which draws, compresses, and discharges a refrigerant. The power of a vehicle engine 20 is transmitted to the compressor 16 through pulleys 22 and a belt 24. As is well known, the vehicle engine 20 drives not only the air conditioning compressor 16 but also such auxiliaries as a generator, a hydraulic pump for a power steering unit, and a coolant pump via belts and other power transmitting devices.

In the refrigeration cycle, the compressor 16 discharges a superheated gas refrigerant of high temperature and high pressure, which flows into a condenser 28. Here, heat exchange is performed with the outside air sent by a cooling fan (not shown), so that the refrigerant is cooled for condensation. The refrigerant condensed in the condenser 28 then flows into a receiver 30, in which the refrigerant is separated into a gas and a liquid. A redundant liquid refrigerant in the refrigeration cycle is stored inside the receiver 30.

The liquid refrigerant from the receiver 30 may be decompressed by an expansion valve 34 into a gas-liquid double phase state of low pressure refrigerant. The low pressure refrigerant from the expansion valve 34 flows into an evaporator 36 by way of an inlet pipe 38. The evaporator 36 is arranged inside an HVAC case 42 of the vehicle air conditioning system 14. The low pressure refrigerant flowing into the evaporator 36 absorbs heat from the air inside the HVAC case 42 during refrigerant evaporation. An outlet pipe 40 of the evaporator 36 may be connected to the suction side of the compressor 16, so that the cycle components mentioned above constitute a closed circuit.

The HVAC case 42 may form a ventilation duct through which air-conditioned air is sent into the passenger compartment. The HVAC case 42 contains a fan 44 which is arranged on the upstream side of the evaporator 36. An inside/outside air switch box (not shown) is arranged on the suction side of the fan 44 (the left side in FIG. 1). The air inside the passenger compartment (inside air) or the air outside the passenger compartment (outside air) switched and introduced through the inside/outside air switch box is sent into the HVAC case 42 by the fan 44.

The HVAC case 42 may accommodate, on the downstream side of the evaporator 36, a hot water heater core (heat exchanger) 46. The heater core 46 includes an inlet pipe 48 and an outlet pipe 50. Hot water (coolant) of the vehicle engine 20 is directed to the heater core 46 through the inlet pipe 48 by a water pump 52. A water valve 54 controls the flow volume of engine coolant supplied to the heater core 46. A radiator 56 and a thermostat 58 further cooperate to control the temperature of the coolant.

A bypass channel 60 is formed beside the hot water heater core 46. An air mix door 62 is provided to adjust the volume ratio between warm air and cool air that passes through the hot water heater core 46 and the bypass channel 60, respectively. The air mix door 62 adjusts the temperature of the air blown into the passenger compartment by adjusting the volume ratio between the warm air and cool air.

Additionally, a face outlet 64, a foot outlet 68, and a defroster outlet 70 may be formed at the downstream end of the HVAC case 42. The face outlet 64 directs air toward the upper body portions of passengers, the foot outlet 68 directs air toward the feet of the passengers, and the defroster outlet 70 directs air toward the internal surface of a windshield. The outlets 64, 68 and 70 may be opened and closed by an outlet mode doors (not shown). The air mix door 62 and the outlet mode doors mentioned above are driven by such electric driving devices such as servo motors via linkages or the like. It is appreciated that the components described in relation to FIG. 1 are merely exemplary. In this way, the following discussion directed to a mounting arrangement for the condenser 28 may be adapted for other configurations where mounting a heat exchanger in a vehicle is necessary.

Figure 2:
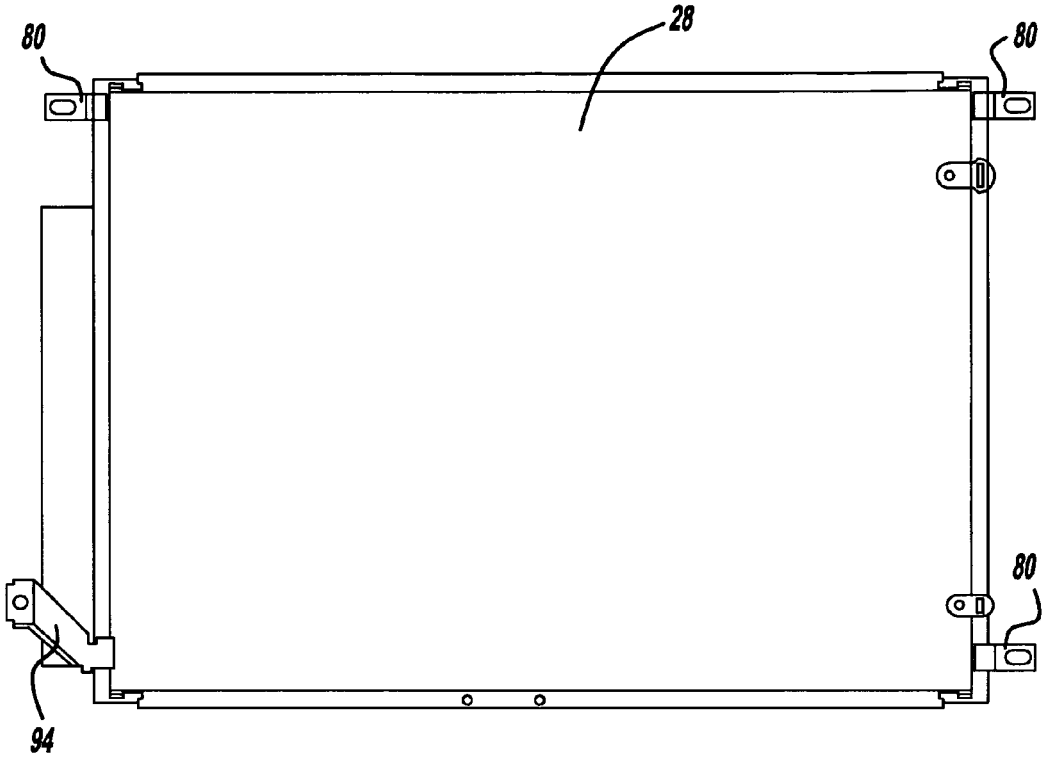
FIG. 2 is a front view of a condenser including mounting brackets according to the present teachings.
Figure 3:
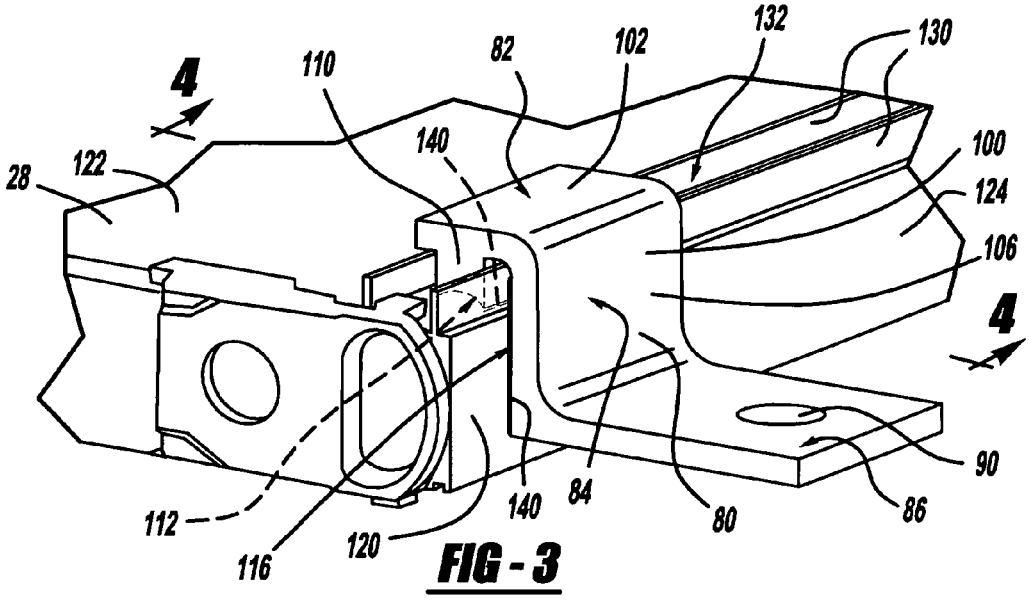
FIG. 3 is a perspective view of a mounting arrangement with a bracket brazed to the condenser according to the present teachings.
Figure 4:
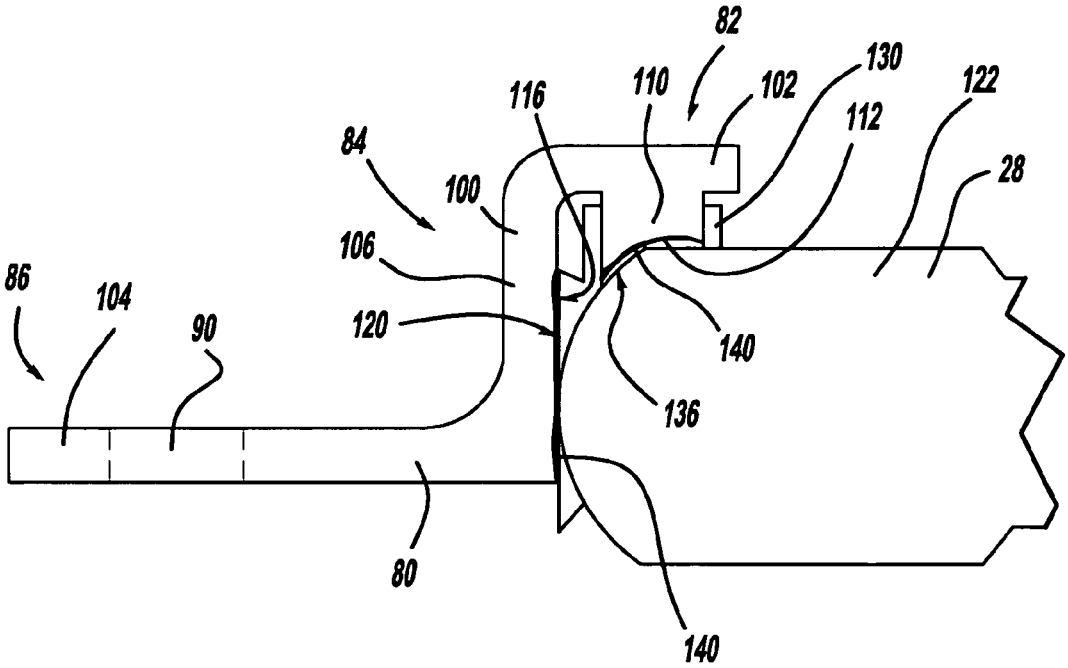
FIG. 4 is a cross-sectional view of the condenser and bracket assembly taken along line 4-4 of FIG. 3.

As will be described in greater detail with reference to FIGS. 2-4, a series of brackets 80 are used to securely mount the condenser 28. In the exemplary configuration illustrated in FIG. 2, three similar brackets 80 are arranged around a perimeter of the condenser 28. It is appreciated that one, two or more than three brackets may alternatively be employed. The brackets 80 are joined to the condenser 28 by a brazing process. The brazing process employed herein allows the bracket 80 to be securely joined directly to the condenser 28 without supplemental fasteners. As a result, reduced packaging requirements may be achieved. It is appreciated that while specific reference will be made to one of the three brackets, the remaining brackets posses the same characteristics and are secured to the condenser in a similar fashion. According to the present teachings and more specific reference to FIGS. 3 and 4, a first end 82 of the bracket 80 is brazed to the condenser 28. In addition, an intermediate portion 84 of the bracket is similarly brazed to the condenser 28. A second end 86 of the bracket 80 defines an opening 90 for receiving fasteners (not shown) for securing the bracket 80 to the radiator 56. A fourth distinct bracket 94 is utilized at a remaining corner of the condenser 28.

With continued reference to FIGS. 3 and 4 the bracket 80 and the mounting arrangement between the bracket 80 and the condenser 28 will be described in greater detail. The bracket 80 generally defines a main body 100 including a first end wall portion 102, a second end wall portion 104 and a central wall portion 106. An extension portion or foot 110 is formed on the first end wall portion 102. The foot 110 defines an arcuate surface 112 adapted to mate with the condenser 28 as will be described. The central wall 106 defines an inboard face 116 (FIG. 4) that engages an outboard face 120 of the condenser 28 in the installed position. The bracket 80 is formed of metal such as extruded aluminum. Other materials may be used.

The condenser 28 generally defines a first outer surface 122 and a second outer surface 124. A pair of laterally extending walls or rails 130 are formed on the first surface 122 and cooperate to define a channel 132. The channel 132 is operable to receive the foot 110 of the bracket 80 in a nested relationship in the installed position. The first surface 122 defines an arcuate surface 136, complementary to the arcuate 112 surface of the bracket 80.

Assembly of the mounting bracket 80 to the condenser 28 will now be described. At the outset, the foot 110 is located into the channel 132 between the respective walls 130. Next, the opposing walls 130 of the channel 132 may be deflected toward each other thereby clamping the foot 110 between the walls 132 and creating a compression fit.

Once the bracket 80 is properly located in the channel 132, brazing material 140 is then disposed at the interface of the foot 110 and the condenser 28. Specifically, brazing material 140 is disposed between the arcuate surface 112 of the foot 110 and the complementary arcuate surface 136 of the condenser 28. Similarly, brazing material 140 is applied to the interface between the inboard face 116 of the bracket 80 and the outboard face 120 of the condenser 28. It is appreciated that the brazing material 140 may be applied to the respective surfaces prior to locating the foot 110 into the channel 132. While the brazing material 140 is specifically described as being disposed at the foot 110 and the central wall 106 of the bracket 80, it is appreciated that the brazing material 140 may be additionally or alternatively be placed at other locations on the bracket 80. Once the brazing material 140 is applied, the entire assembly is subsequently brazed through a heat application such as within a furnace.

Those skilled in the art will readily appreciate that while the foot 110 is described as being temporarily held to the condenser 28 by deforming the opposing walls 130, other methods may be employed. For example, mechanical or chemical coupling material such as, but not limited to, wire wrapping may be placed in any location sufficient to temporarily couple the bracket 80 to the condenser 28. Furthermore, the channel 132 may be configured to receive the foot 110 as an interference fit, without the need to form a compression fit.

Employing the teachings described and depicted in the drawings yield advantages such as reduced parts compared to brackets that are bolted or press-fit to the condenser. Furthermore, a brazed or welded joint is a more rigid construction than a bolted joint. Additionally, fewer manufacturing steps are required since the brackets 80 and condenser 28 are brazed along with other parts of the condenser 28. Finally, the curved surface 112 of the bracket 80 that interfaces with the curved surface 136 of the condenser 28 provides a consistent, continuous fit that provides secure holding for the condenser 28.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A mounting arrangement in combination with a heat exchanger, said heat exchanger defining a channel, which is defined by a pair of offset lateral walls running along a first outboard face of said heat exchanger, said combination further comprising:

a bracket having a main body including a first portion secured to the heat exchanger and a second portion including a mounting feature adapted to be secured to a vehicle, the main body defining first and second end walls connected by a central wall, the first and second end walls being parallel and offset to each other, the central wall being perpendicular to the first and second end walls; and a foot extending perpendicular from said first end wall of said main body of the bracket toward the heat exchanger, the foot defining an interface surface brazed to the heat exchanger, the foot being disposed anywhere along and within the channel of said heat exchanger; wherein the central wall defines an inboard face engaging the heat exchanger.

2. The combination of claim 1 wherein said inboard face of the central wall is brazed to an outboard face of the heat exchanger.

3. The combination of claim 1 wherein said bracket is formed of metal.

4. The combination of claim 3 wherein said bracket is formed of extruded aluminum.

5. The mounting arrangement of claim 1, wherein said central wall of said bracket resides outside of said channel.

6. A mounting arrangement in combination with a heat exchanger comprising:

a bracket having a main body including a first end portion secured to the heat exchanger, an intermediate portion secured to the heat exchanger, a second end portion including a mounting feature adapted to be secured to a vehicle and a foot extending perpendicular from the first end portion toward the heat exchanger, the foot being parallel to the intermediate portion, the intermediate portion being perpendicular to the first and second portions; and wherein the first end portion and the intermediate portion are brazed to the heat exchanger and the foot is disposed within a channel on said heat exchanger perpendicular to the second end portion of said bracket.

7. The combination of claim 6 wherein the heat exchanger defines a pair of offset lateral walls formed thereon defining said channel and wherein the foot is disposed between the pair of lateral walls.

8. The combination of claim 7 wherein the first and second end portions define planar wall portions that are parallel and offset to each other.

9. The combination of claim 8 wherein the intermediate portion defines a central wall is transverse to the first and second planar wall portions.

10. The combination of claim 9 wherein the central wall defines an inboard face engaging the heat exchanger.

11. The combination of claim 10 wherein said inboard face of the central wall is brazed to an outboard face of the heat exchanger.

12. The combination of claim 6 wherein said bracket is formed of metal.

13. The combination of claim 12 wherein said bracket is formed of extruded aluminum.

14. The mounting arrangement of claim 6, wherein said intermediate portion is secured to an end of the heat exchanger, perpendicular to, and offset from said channel.

15. The mounting arrangement of claim 6, wherein portion of said foot is brazed to the heat exchanger perpendicular to where said intermediate portion is secured to the heat exchanger.

* * * * *